United States Patent [19]

Alameda et al.

[11] Patent Number: 5,046,304

[45] Date of Patent: Sep. 10, 1991

[54] APPARATUS AND METHOD FOR BAGGING FRAGILE LEAFY VEGETABLES

[75] Inventors: Robert Alameda, Northport, Wash.; Daniel Alameda, Pacific Grove, Calif.

[73] Assignee: Gabilan Manufacturing, Inc., Salinas, Calif.

[21] Appl. No.: 484,412

[22] Filed: Feb. 26, 1990

[51] Int. Cl.[5] ..... B65B 43/26

[52] U.S. Cl. ..... 53/570; 53/258; 53/529; 100/229 A; 141/73; 141/316

[58] Field of Search ..... 53/255, 257, 258, 260, 53/261, 436, 438, 459, 469, 473, 529, 570, 573; 100/179, 188 R, 232, 229 A; 141/73, 80, 114, 249, 313, 314, 316, 390

[56] References Cited

U.S. PATENT DOCUMENTS

| | | | |
|---|---|---|---|
| 3,088,499 | 5/1963 | Rieger | 53/529 X |
| 3,179,131 | 4/1965 | Kissling . | |
| 3,252,737 | 5/1966 | Seaton | 53/436 X |
| 3,405,744 | 10/1968 | Bowman | 100/229 A X |
| 3,490,195 | 1/1970 | Abramson | 53/572 X |
| 3,501,890 | 3/1970 | Hunt | 53/529 |
| 3,563,168 | 2/1971 | Dominger . | |
| 3,842,569 | 10/1974 | McClelland et al. . | |
| 4,019,547 | 4/1977 | Ross . | |
| 4,292,786 | 10/1981 | Long et al. . | |
| 4,408,440 | 10/1983 | Van Kesteren, Jr. . | |
| 4,483,878 | 11/1984 | Van Kesteren, Jr. | 53/436 X |
| 4,590,747 | 5/1986 | Schjeldahl . | |
| 4,593,516 | 6/1986 | Alameda et al. . | |
| 4,607,478 | 8/1986 | Maglecic . | |

*Primary Examiner*—John Sipos
*Assistant Examiner*—Daniel B. Moon
*Attorney, Agent, or Firm*—Flehr, Hohbach, Test, Albritton & Herbert

[57] ABSTRACT

An apparatus for mechanically bagging relatively fragile, leafy vegetables including a bag distending assembly, a sleeve-like inserter, a barrier movably mounted inside the inserter, and a drive assembly coupled to displace the inserter into the bag. The drive assembly includes two pneumatic cylinders so that the barrier can be controlled independently of the inserter and maintained in position inside the bag while the inserter is withdrawn. The inserter carries the leaves inside the bag without substantially compresssing or crushing and bruising the leaves, and the barrier permits inserter withdrawal without leaf damage. A process for inserting fragile leafy vegetables into a bag also is disclosed.

9 Claims, 4 Drawing Sheets

APPARATUS AND METHOD FOR BAGGING FRAGILE LEAFY VEGETABLES

TECHNICAL FIELD

The present invention relates, in general, to the packaging of produce in bags, such as plastic bags, and more particularly, relates to the automatic or mechanical bagging of fragile leafy vegetables such as spinach and lettuce.

BACKGROUND ART

The distribution of various kinds of produce in thin, usually transparent, plastic bags has usually become widespread over the years. Produce such as carrots, for example, are easily bagged using mechanical bagging apparatus because the product itself has considerable strength. Typical of prior art carrot bagging apparatus are the devices disclosed in U.S. Pat. No. 4,593,516 to Alameda et al.; U.S. Pat. No. 3,842,569 to McClelland et al.; and U.S. Pat. No. 4,607,478 to Maglecic.

The mechanical or automated packaging of leafy vegetables is most successfully accomplished when the vegetables can be shredded, chopped, or are susceptible to compression during the packaging process. Thus, U.S. Pat. No. 4,408,440 to VanKesteren; U.S. Pat. No. 4,292,786 to Long et al.; U.S. Pat. No. 4,019,547 to Ross; and U.S. Pat. No. 3,179,131 to Kissling are all typical of automated apparatus for packaging cut, shredded or iced leafy vegetables in which the bagging process involves substantial compression of the product.

Although not employed in connection with produce, the bagging of a variety of other particulate products, which are highly compressed, is also known. In U.S. Pat. No. 3,563,168 to Doninger, for example, garbage is highly compressed in a sleeve positioned inside a garbage container or receptacle as part of automatic trash packaging apparatus.

In commercial practice, however, fresh, whole-leaf vegetables such as spinach and certain types of lettuce have not been mechanically packed without excessive damage to the produce. Thus, bagging of fresh, rather fragile, leafy vegetables without damage usually is accomplished by hand. Commercial processes for the same, therefore, have been undesirably labor intensive, and attempts at mechanical packaging have been largely unsatisfactory.

Accordingly, it is an object of the present invention to provide an apparatus for the bagging of fresh, relatively fragile, leafy vegetables which permits same to be accomplished automatically without commercially unacceptable damage to the produce.

Another object of the present invention is to provide an apparatus and method for packaging leafy vegetables, such as spinach and leaf lettuce, which will enable the bagging of same with minimal product crushing and bruising.

Still another object of the present invention is to provide an automatic spinach and lettuce bagging apparatus and method which is suitable for use with fresh, whole-leaf produce and is much more economical than hand bagging of such produce.

Still a further object of the present invention is to provide an apparatus method for bagging leafy vegetables which is suitable for use with automated bag forming apparatus to provide an integrated bag forming and bagging system.

The leafy vegetable bagging apparatus and method of the present invention have other objects and features of advantage which will become apparent, or are set forth in more detail in, the accompanying drawing and following description of the Best Mode of Carrying Out the Invention.

DISCLOSURE OF THE INVENTION

The apparatus for bagging relatively fragile leafy vegetables of the present invention comprises, briefly, a distending assembly formed for holding an open ended bag in a distending condition for receipt of the vegetables, a sleeve-like inserter mounted proximate the distending assembly and dimension to receive a quantity of vegetables in loose and substantially uncompacted condition, insertion drive apparatus coupled to and driving one of the distending means and inserter to produce relative displacement to position the inserter inside the bag, a traverse barrier movably mounted inside the inserter, a barrier drive coupled to the barrier, and a control circuit maintaining the relative position of the barrier and inserter during insertion of the inserter into the bag and further substantially maintaining the relative position of the barrier in the bag during removal of the inserter from the bag. The inserter and barrier thereby carry the vegetable into the bag without compressing the same significantly and then the inserter is removed from the bag while the barrier is maintained in place in the bag. Thereafter the barrier is removed to leave the leafy vegetable in the bag in a relatively uncompressed condition.

The process for bagging fragile, leafy vegetables of the present invention is comprised, briefly, of the steps of placing a quantity of leafy vegetables in a loose, uncompacted condition inside a sleeve-like inserter, inserting the inserter with the vegetables into an open end of the bag to a positioning substantially all of the vegetables in to the bag, and withdrawing the inserter from the bag while preventing the vegetables from leaving the bag by a barrier or the like.

BEST MODE OF CARRYING OUT THE INVENTION

Figure 1:
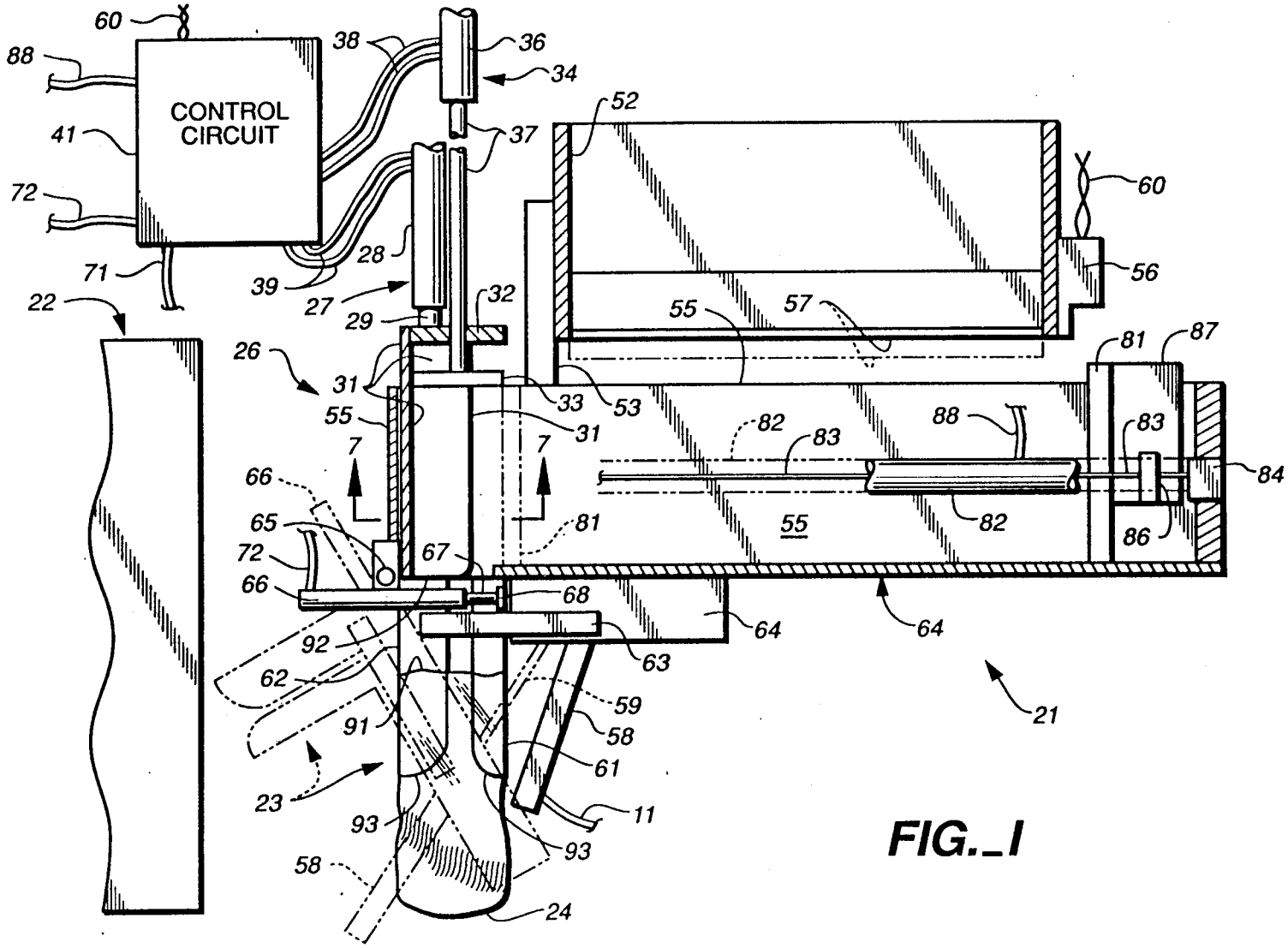
FIG. 1 is a schematic, side elevation view, in cross-section, of a leafy vegetable bagging apparatus constructed in accordance with the present invention.

The leafy vegetable bagging apparatus of the present invention can best be understood by reference to FIG. 1 in which a bagging apparatus, generally designated 21, is seen to be mounted proximate to a bag forming apparatus, generally designated 22. Bagging apparatus 21 includes bag distending means 23 formed for holding an open end 91 of open-ended bag 24 in a distended condition as shown in FIG. 1, for the receipt of leafy vegetables.

In the form of the invention shown in the drawing, bag distending means 23 is moveable about pivotal joint 65 between a first position, shown in phantom, for receipt of bags from bag forming apparatus 22 and a second position, shown in solid lines, in which the bag is distended for receipt of the leafy vegetables.

Mounted proximate bag distending means 23 is a sleeve-like inserter means, generally designated 26, which is dimensioned to receive a quantity of leafy vegetables in a loose, substantially uncompacted condition. Inserter means 26 also is dimensioned for insertion into bag 24 through distending means 23 while the bag is mounted on the distending means.

In order to effect insertion of the inserter into the bag, the insertion drive means, generally designated 27, is coupled to one of distender 23 and inserter 26 so as to produce relative displacement resulting in insertion of the inserter into bag 24. In the preferred form of the invention as shown in FIG. 1, insertion drive means 27 takes the form of a cylinder 28 having a piston 29 extending therefrom and coupled to semi-circular inserter sleeve-like member 31 by a transverse mounting wall or member 32. Most preferably a pneumatic drive assembly 27 drives inserter 26, and it is formed to displace the inserter between an inserted position (FIG. 5) in which the inserter is inserted inside bag 24 to a depth positioning substantially all of the leafy vegetables inside the bag, and a removed position (FIG. 1) in which the inserter is positioned outside of bag 24. A relatively long stroke is used, and cylinder 28 and piston 29 are preferably of a length which will permit the displacement required for movement of the inserter between the inserted position and removed position.

In order to insure that vegetables inserted into bag 24 by the inserter 26 are not removed from the bag when the inserter is retracted, the apparatus of the present invention includes barrier means, 33 which is movably mounted inside inserter sleeve 31 and extends transversely across the inserter to act as a barrier during inserter retraction. Barrier drive means, generally designated 34, is coupled to barrier 33 for displacement thereof. In the preferred form, barrier drive means 34 is a pneumatic cylinder 36 having a piston 37 which slidably extends through inserter end wall 32 and is fixedly connected to barrier member 33 for displacement of the same.

Both the insertion drive means 27 and the barrier drive means 34 are pneumatically or hydraulically coupled, as by conduits 38 and 39, to control circuit means 41, which controls the sequencing of the operation of the two drives.

In the leafy vegetable bagging apparatus of the present invention sequencing and operation of the two drives is controlled by control circuit means 41 in a manner which results in carrying of uncompacted produce leaves into bag 24 and withdrawal or retraction of the inserter while the barrier prevents withdrawal of the leaves. Moreover, the insertion or bagging of the produce leaves takes place without substantial compression or compacting of the leaves, which would bruise or damage same. This is accomplished by control circuit 41 operating insertion drive means 27 and barrier drive means 34 so that barrier 33 and inserter 26 move as a unit to place the leaves into bag 24 during the insertion process. During the removal process, inserter 26 is removed while the barrier 33 is maintained in substantially same relative position with respect to bag 24 so that produce leaves are not pulled or withdrawn from the bag with the inserter. Finally, the control circuit actuates barrier drive means 34 to withdraw the barrier from the bag and permit the open bag end to be closed and banded.

A step-by-step description process of the present invention, as well as for the details of the apparatus of the present invention, can be set forth by reference to FIGS. 2–6.

Figure 2:
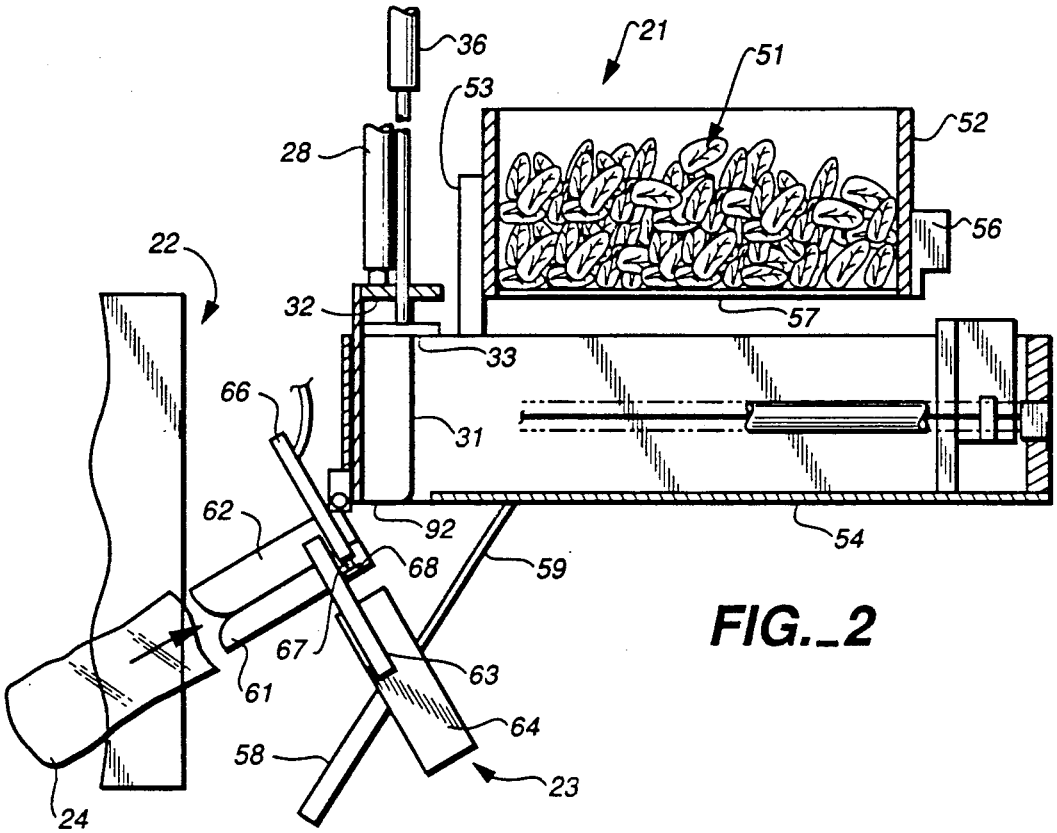
FIG. 2 is a reduced scale side elevation view corresponding to FIG. 1, and showing the apparatus in a position to receive a bag and having produce in a weighing hopper.

In FIG. 2, a quantity of leafy vegetables 51 have been placed in open topped weighing hopper 52. Such hoppers are well known in the produce packaging field, and they include a support frame 53 for support of the weighing hopper over an open topped horizontal transfer trough 54, as well as a weighing circuit (not shown), a pair of moveable hopper doors 57 at the bottom of the hopper, and door opening mechanism 56 which controls discharge of weighed vegetables 51 into transfer trough 54. Door opening mechanism 56 is preferably electrically controlled through conductors 60 coupled to control means 41. It will be understood, however, that mechanism 56 can also be pneumatically actuated and integrated with the pneumatic logic circuitry of control means 41.

In the position of FIG. 2, bag distending assembly 23 is pivoted or moved, for example, by cylinder 58 and piston 59 to a first position for receipt of bag 24 from bag forming apparatus 22. Bag distending assembly 23 advantageously can include a pair of snout-like semi-circular shells 61 and 62 which are relatively moveable between a contracted condition, shown in solid lines in FIG. 2, and an expanded condition, shown in solid lines in FIG. 1 and FIG. 3. In the preferred form, stationary shell 62 is secured by a pair of arms or brackets 63 to a body 64 of a distending assembly 23. Snout-like shell member 61 is movably mounted between arms 63 and is driven by a piston and cylinder assembly. Cylinder 66 may be attached to shell member 62, for example, by a bracket or welding, and piston 67 is coupled to an ear 68 on movable shell 61. Pneumatic cylinders 58 and 66 are both coupled by conduit means 71 and 72, respectively, to pneumatic control circuit means 41.

When the bag distending assembly 23 is in the bag receiving position of FIG. 2, the snout-like shell half 61 is in a contracted position to receive the open end of bag 24 from bag forming machine 22. The diameter of the snout assembly 61, 62, when contracted, is less than the diameter of bag 24. Once bag 24 is inserted along the snout shell member 61 and 62, controller 41 causes cylinder 66 to displace shell member 61 to the right so as to distend the bag and frictionally retain the bag on snout 61, 62. While shown in a side elevation view, it will be appreciated that the snout shell members 61 and 62 have a width dimension into the paper which is less than the corresponding dimension of the bag so that the bag can be inserted over the shells 61, 62. Distention by cylinder 66, therefore, slightly distends the bag along the axis of displacement member 61 to effect trapping of the bag on the distention assembly snout members.

The construction of the bag forming apparatus 22 does not constitute a portion of the novelty of the present invention. Bag forming apparatus suitable for use with the leafy vegetable apparatus of the present invention are described in U.S. Pat. No. 4,590,747 to Alameda et al., and will not be described in further detail herein. Other bag forming apparatus capable of inserting an open-ended bag onto shell-like snout member 61, 62 are suitable for use with apparatus of the present invention.

Figure 3:
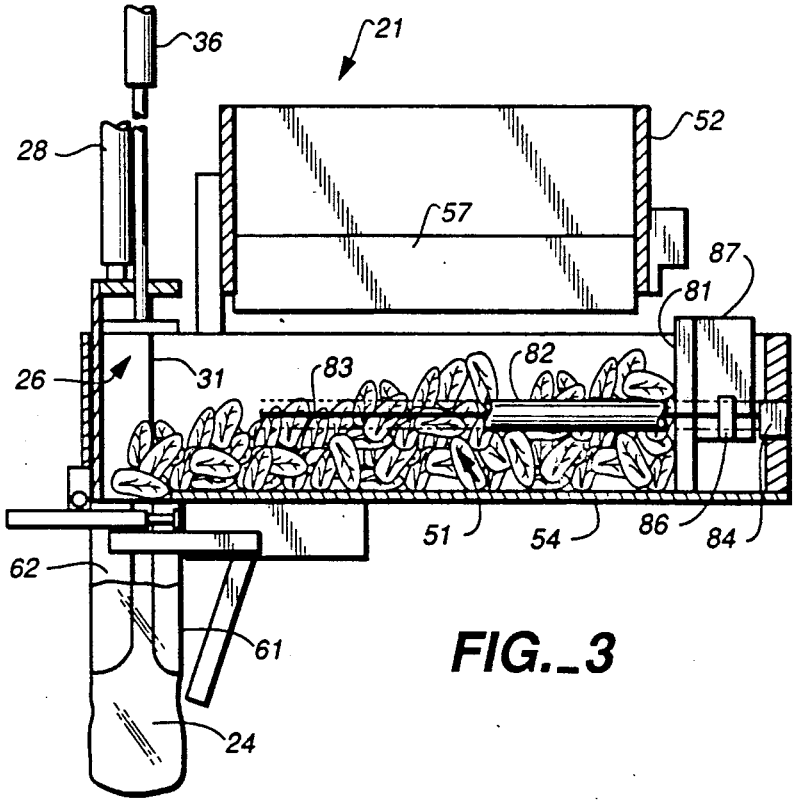
FIG. 3 is a side elevation view corresponding to FIG. 2 with the bag mounted on the apparatus of the present invention and the leafy vegetables in a moved position in a transfer trough.

Once bag 24 is mounted on snout members 61, 62, controller 41 causes cylinder 58 to pivot body 64 of the assembly about pivot 65 to the second or bag filling position shown in FIGS. 1 and 3. At about the same time, controller circuit 41, which is coupled to operate hopper doors 57 through conductors 60, will open hopper doors 57 and thereby dump the weighed quantity of leafy vegetables 51 into opentopped, horizontal, transfer trough 54, as shown in FIG. 3.

Figure 4:
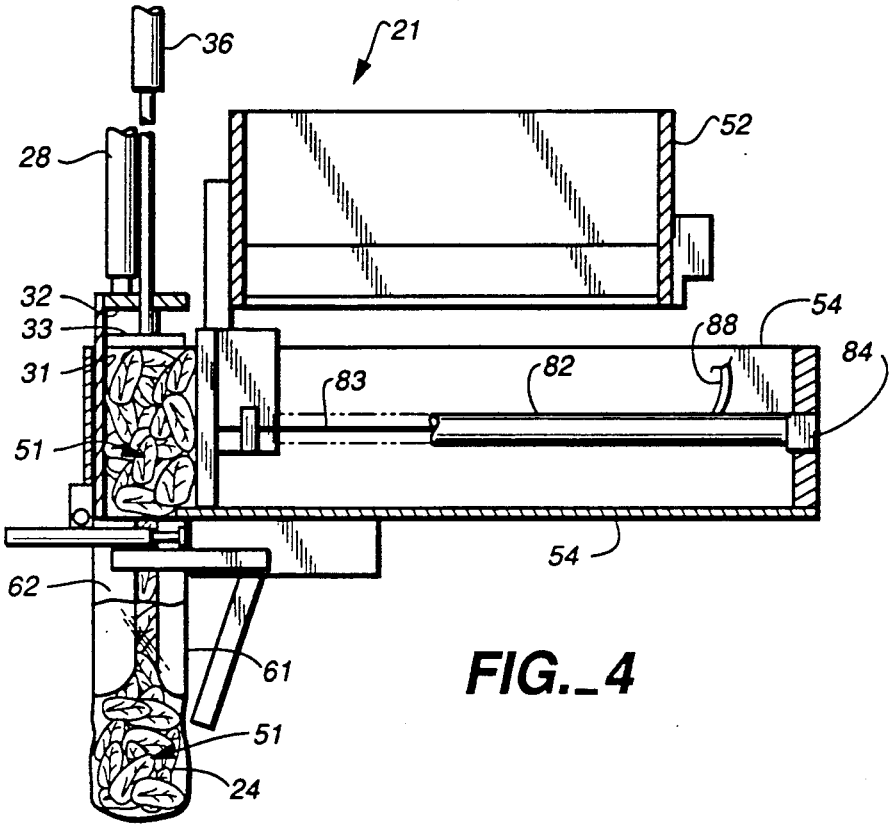
FIG. 4 is a side elevation view corresponding to FIG. 3 showing the vegetables transferred to a vertical channel aligned with the bag and an inserter sleeve.

As can be seen, horizontal transfer trough 54 includes a pusher or transfer wall 81 which is mounted for movement between the position of FIG. 3, for the receipt of produce 51 from hopper 52 and the position of FIG. 4, for transfer of leafy vegetables 51 to the inserter assembly 26. Thus, trough 54 extends outwardly beyond hopper 52 so that the vegetables will fall between transfer wall 81 and inserter 26.

Figure 7:
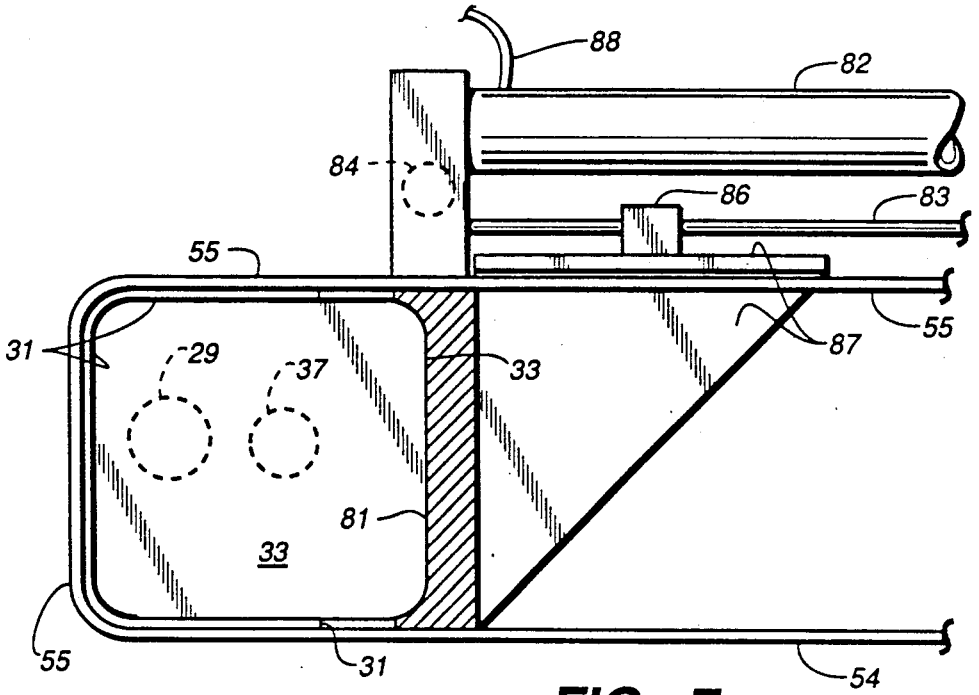
FIG. 7 is a fragmentary, enlarged, cross-sectional view, taken substantially along the plane of line 7—7 in FIG. 1.

Displacement of moveable transfer wall 81 to the position in FIG. 4 can be accomplished in a number of different manners. In the preferred form, a pneumatic cylinder 82 is provided which has a moveable piston coupled to a flexible cable 83. Mounted proximate each end of trough 54 is a pulley assembly 84. The pulley assembly at the right end of trough 84 is shown in FIG. 1, and a second pulley assembly 84 is schematically shown in FIG. 7. Both assemblies 84 are mounted on the outside wall 55 of trough 54 proximate the opposite ends of trough 54. The piston in cylinder 82 is used to displace flexible cable 83, which in turn is coupled to an ear 86 on a movable triangular bracket 87 (FIG. 7) fixedly mounted to the back of movable wall or partition 81. Conduit means 88 couples the piston cylinder assembly 82 to the control circuit 41. The controller 41 can be used, therefore, to drive pusher or wall 81 from the position of FIG. 3 to the position of FIG. 4.

As best may be seen in FIG. 7, transfer barrier or pusher member 81 can be connected by a triangular bracket member 87, which passes out over the top of the side wall 55 of horizontal transfer trough 54. The flange or ear 86 protrudes outwardly from member 87, and flexible cable 83 is coupled to ear 86. As also may be seen from FIG. 7, it is preferable that the inner face of pusher or transfer barrier 81 be formed to mate with the peripheral edge of the downwardly displaceable barrier member 33 and downwardly displaceable end wall 32 of the inserter.

As can be seen by comparing FIGS. 2 and 3, the leafy vegetables 51 are dropped in a loose, substantially uncompacted condition into horizontal transfer trough 54. Displacement of barrier 81 from the position of FIG. 3 to the position of FIG. 4 causes vegetable leaves 51 to be transferred to inserter 26 in a condition which remains substantially uncompacted. As will be seen in FIG. 4, some of the leaves will fall down into bag 24 and some remain between moveable wall 81 and shell-like sleeve inserter 31. Thus, the volume defined between inserter 31 and barrier wall 81 in the position of FIGS. 4 and 7, as well as the volume between the snout members 61, 62 and the volume of open bag 24 will accommodate vegetables 51 without crushing or significantly compacting the leafy vegetables. Some compaction will take place by reason of the transfer of the vegetables from horizontal trough 54 to the inserter over bag 24, but this compaction is largely accommodated by relative shifting of the leaves to fill the voids therebetween, as opposed to crushing or compaction of the leaves. As used herein, therefore, the expression "substantially uncompacted" shall mean that the compaction of the leaves shall not be sufficient to cause a commercially unacceptable level of crushing, bruising, or damaging of the leaves.

Figure 5:
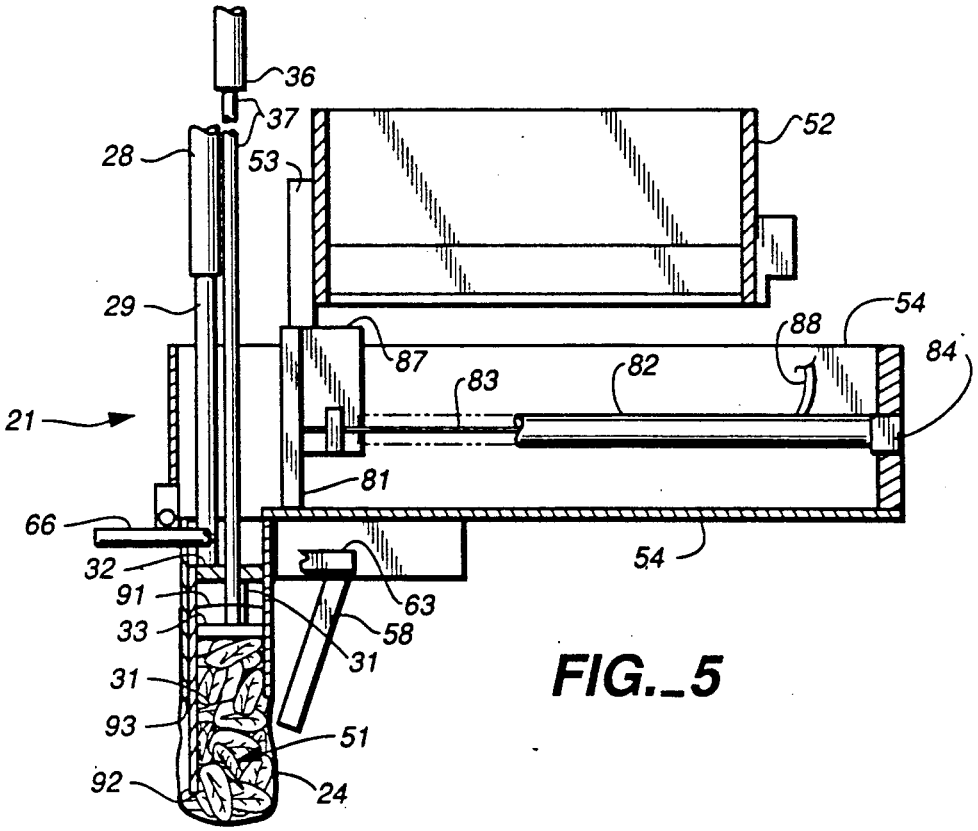
FIG. 5 is a side elevation view corresponding to FIG. 4 in a slightly enlarged scale showing the leafy vegetables inserted into the bag by the inserter.

Insertion of the leafy vegetables 51 into bag 24 takes place while transfer wall 81 remains in the position of FIGS. 4 and 5. The inserter drive means and barrier drive means are both actuated to downwardly displace pistons 29 and 37. This moves the end wall 32 and shell member 31 as well as transverse barrier 33 substantially as a unit to the position shown in FIG. 5. As will be seen in FIG. 5, barrier wall 33 is positioned inside open end 91 of bag 24. Additionally, lower end 92 of shell-like inserter member 31 is displaced beyond the lower end 93 of snout 61, 62. The result is that the inserter assembly carries, rather than compresses, the leaves of produce into bag 24.

Again, the primary mechanism for volume reduction of the produce is relative shifting between the leaves to further reduce the voids or rather the detrimental bending, compressing and bruising or breaking of the leaves. The leafy vegetable mass 51, therefore, has been inserted or placed, rather than compressed, into bag 24 by inserter assembly 26, and the combination of the horizontal transfer and the vertical insertion, without significant compression, produces enough relative movement between the leaves to effect the volume reduction needed.

Figure 6:
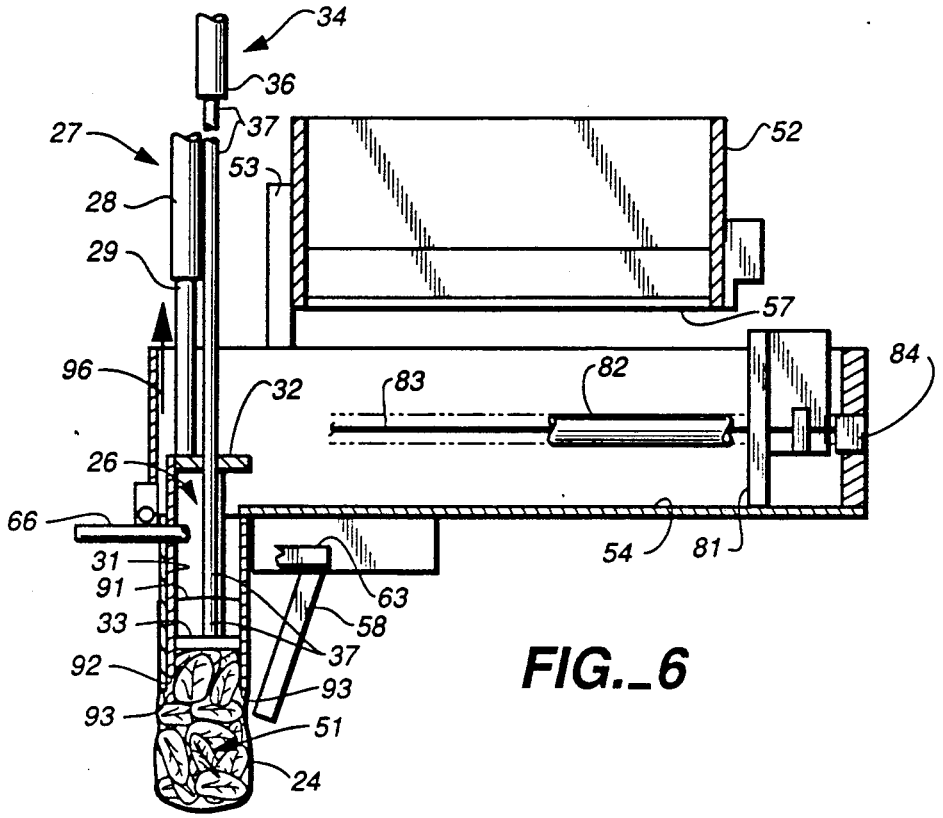
FIG. 6 is a side elevation view corresponding to FIG. 5 showing the inserter removed from the bag prior to the removal of the retaining barrier and commencement of a new bagging cycle.

During withdrawal of inserter means 36 from bag 24 control circuit 41 maintains the relative position of barrier 33 to bag 24. As can be seen in FIG. 6, therefore, cylinder 28 moves piston 29 and end wall 32 of the inserter in the direction of arrow 96. The lower end 92 of inserter sleeve 31 is shown in FIG. 6 in a position above the lower end 93 of snout members 61 and 62. Inserter sleeve 31 will continue to be displaced to return to the position of FIG. 1.

Withdrawal of leafy vegetables 51 from the bag is prevented during retraction or withdrawal of inserter 26 by transverse barrier 33. Piston 37, which controls the movement of barrier 33, slidably passes through end wall member 32 of the inserter sleeve. Accordingly, control circuit 41 maintains barrier 33 below the upper end 91 of the bag as the inserter sleeve is withdrawn.

In order to facilitate tying off the bag, cylinder 36 even can move slightly downwardly toward the bag, for example, by about an inch. This small relative movement between barrier 33 and bag 24 during retraction of inserter shell 31 is optional. Comparison of FIGS. 5 and 6 and the position of barrier 33 relative to the top end 91 of the bag illustrates the minor nature of such downward barrier displacement. The amount of displacement, if any, during this step of the bagging process cannot be so substantial to crush or bruise leafy vegetables 51.

After removal of inserter sleeve 31 from contact with leafy vegetables 51, and slight downward displacement of barrier 33, if desired, barrier 33 is also retracted by drive means 34 to the position of FIG. 1.

It also will be seen from FIG. 6 that transfer wall 81 has been returned to the right hand position for receipt of a new quantity of leafy vegetables into hopper 54. This return can take place at any time after the inserter and barrier assembly have carried the leaves downwardly into bag 24 past the lower edge of horizontal transfer trough 54.

As will be seen from review of FIGS. 1 through 6, therefore, the process of the present invention is comprised, broadly, of the steps of placing a quantity of leafy vegetables to be bagged in a loose, substantially uncompact condition inside a sleevelike inserter 26, inserting the inserter with the vegetables into an open end of bag 24 to a depth positioning substantially all of leafy vegetables 51 inside the bag, and withdrawing the inserter from the bag while preventing vegetables 51 from leaving the bag. The inserting and withdrawing steps are preferably accomplished by moving inserter 26, while maintaining the bag in a stationary condition; moving barrier 33 with the inserter during the inserting step; and maintaining barrier 33 in a substantially stationary condition during withdrawal of inserter sleeve 31.

What is claimed is

1. An apparatus for bagging a quantity of relatively fragile leafy vegetables comprising:

bag distending means holding an open ended bag in a distended condition for receipt of said vegetables through the open end thereof;

sleeve-like inserter means mounted proximate said distending means and dimensioned to receive said quantity of said vegetables in a loose substantially uncompacted condition therein and dimensioned for insertion into said open end of said bag while said bag is in said distended condition and said vegetables are in said uncompacted condition;

insertion drive means coupled to and driving at least one of said distending means and said inserter means and producing relative displacement of said inserter means and said distending means between an inserted position, in which said inserter means is inserted inside said bag to a depth positioning substantially all of said quantity of said vegetables inside said bag, and a removed position, in which said inserter means is positioned outside of said bag;

barrier means movably mounted inside said inserter means, said inserter means extending substantially around three sides of said barrier means, and said barrier means extending transversely across said inserter means to cooperate with an interior surface of said inserter means to carry said vegetables into said bag in said uncompacted condition;

barrier drive means coupled to said barrier means for displacement thereof; and control means coupled to said insertion drive means and said barrier drive means and substantially maintaining the relative position of said barrier means and said inserter means during insertion of said inserter means into said bag, and substantially maintaining the relative position of said barrier means and said bag during removal of said inserter means from said bag to prevent withdrawal of said vegetables from said bag during removal of said inserter means.

2. The apparatus as defined in claim 1 wherein, said bag distending means is provided by snout-like assembly dimensioned for insertion into an open end of said bag, and movable between a bag distending position and a bag releasing position.

3. The apparatus as defined in claim 2 wherein, said snout-like assembly includes a pair of laterally displacable shell-like members mounted for movement between a contracted condition for insertion into said open end of said bag and an expanded condition distending said bag therebetween.

4. The apparatus as defined in claim 3 wherein, said inserter means is sized for insertion into said bag by passage thereof inside said shell members when said shell members are in said expanded condition.

5. The apparatus as defined in claim 1 wherein, said insertion drive means is coupled to displace said inserter means while said distending means is substantially stationary.

6. The apparatus as defined in claim 5 wherein, said barrier drive means drives said barrier means for movement with said inserter means in substantially fixed relation thereto during displacement of said inserter means into said bag.

7. The apparatus as defined in claim 6 wherein, said barrier drive means maintains said barrier means in a substantially fixed position during displacement of said inserter means as said inserter means is removed from said bag.

8. The apparatus as defined in claim 1, and vegetables weighing means positioned proximate said inserter means; and vegetable transfer means positioned to receive said vegetables in a loose, substantially uncompacted condition from said weighing means and formed to transfer said vegetables to said inserter means.

9. In an apparatus for bagging a quantity of leafy vegetables including holding means holding an open ended bag in an open condition for receipt of said vegetables, shell-like inserter means mounted proximate said holding means and dimensioned to receive said quantity of said vegetables in a loose substantially uncompacted condition and dimensioned for insertion into said bag, insertion drive means coupled to and driving one of said holding means and said inserter means and producing relative displacement therebetween for insertion and removal of said inserter means into and out of said bag, wherein the improvement in said apparatus comprises:

barrier means movably mounted inside said inserter means, said barrier means extending transversely across said inserter means to cooperate with an interior surface of said inserter means to carry said vegetables into said bag in said uncompacted condition;

barrier drive means coupled to said barrier means for displacement thereof; and control means coupled to said insertion drive means and said barrier drive means and substantially maintaining the relative position of said inserter means and said barrier means during insertion thereof into said bag, and substantially maintaining the relative position of said barrier means and said bag during removal of said inserter means from said bag to prevent withdrawal of said vegetables from said body during removal of said inserter means.

* * * * *